United States Patent [19]

Bouvaist et al.

[11] 4,177,086

[45] Dec. 4, 1979

[54] PROCESS FOR THE THERMAL TREATMENT AND THE QUENCHING OF FORGED ARTICLES

[75] Inventors: Jean-Marie A. Bouvaist, Grenoble; Georges Lacoste, Issoire, both of France

[73] Assignee: Societe pour le Forgeage et l'Estampage des Alliages Legers FORGEAL, Paris, France

[21] Appl. No.: 890,680

[22] Filed: Mar. 27, 1978

[30] Foreign Application Priority Data

Mar. 31, 1977 [FR] France ..... 77 10496

[51] Int. Cl.[2] ..... C22F 1/04

[52] U.S. Cl. ..... 148/12.7 A; 148/13.1; 148/159

[58] Field of Search ..... 148/13.1, 12.7 A, 159

[56] References Cited

U.S. PATENT DOCUMENTS 3,850,705 11/1974 Furney et al. ..... 148/13.1

*Primary Examiner*—R. Dean

*Attorney, Agent, or Firm*—Webb, Burden, Robinson & Webb

[57] ABSTRACT

A process for the treatment of a finished or semi-finished forged product made from billets or cast plates of age-hardening aluminium alloys useful in aeronautical applications is provided. The process includes thermally treating the product between the solidus temperature of equilibrium ($T_1$) and the liquidus temperature ($T_2$) for a period of 0.5 to 12 hours. The entire surface of the product is coated with an insulating coating and then the product is solution heat treated, and quenched in hot or boiling water.

6 Claims, 12 Drawing Figures

250 mm
25
2.5
150
75
24°c
66°c
82°c
93°c
100°c
0.1
1
10
$10^2$
$10^3$
°C/second

PROCESS FOR THE THERMAL TREATMENT AND THE QUENCHING OF FORGED ARTICLES

BACKGROUND OF THE INVENTION

This invention relates to the thermal treatment and quenching of forged articles, and more particularly, to the thermal treatment and quenching of forged articles of aluminium alloys useful in aeronautical applications.

Problems arise when quenching articles composed of aluminium alloys, and more particularly, articles of evolutionary shape and of variable cross sections such as those obtained by forging or stamping. These problems are more particularly acute when age-hardening aluminium alloys of the type useful in aeronautical applications are quenched.

Typical processes for quenching are taught in French Certificates of Addition Nos. 2,293,496 and 2,256,960. In accordance with the present invention, a process for thermally treating and quenching age-hardening aluminium alloys is provided in which the alloy develops excellent physical properties for aeronautical applications.

SUMMARY OF THE INVENTION

A process for the treatment of a finished or semi-finished forged product made from billets or cast plates of age-hardening aluminium alloys useful in aeronautical applications is provided. The process includes thermally treating the product between the solidus temperature of equilibrium ($T_1$) and the liquidus temperature ($T_2$) for a period of 0.5 to 12 hours. The entire surface of the product is coated with an insulating coating, then the product is solution heat treated and quenched in hot or boiling water.

DETAILED DESCRIPTION OF THE INVENTION

The process of the invention applies to high aluminium alloys capable of age-hardening, exemplary of such alloys are the following:

The 2000 series alloys such as: Al-Cu Al-Cu-Mg Al-Cu-Mg-Si, also such as: A-$U_4G_1$ 2024 or A-$U_4SG$ 2014.

The 6000 series alloys such as: Al-Mg-Si

The 7000 series alloys such as: Al-Zn-Mg Al-Zn-Cu-Mg.

The process of the invention is most particularly useful with regard to those alloys which are used widely in aeronautical construction owing to their high physical properties and in particular with regard to the 7000 series alloys shown in the following table.

TABLE I

| Alloy | Si* | Fe* | Cu* | Mn* | Mg* | Cr* | Zn* | Ti* | Zr* | Al* |
|---|---|---|---|---|---|---|---|---|---|---|
| 7075 | up to 0.40 | up to 0.50 | 1.2–2.0 | up to 0.30 | 2.1–2.9 | 0.10–0.35 | 5.1–6.1 | Ti + Zr = up to 0.25 | | Bal. |
| 7175 | up to 0.15 | up to 0.20 | 1.2–2.0 | up to 0.10 | 2.1–2.9 | 0.18–0.30 | 5.1–6.1 | up to 0.10 | — | Bal. |
| 7475 | up to 0.10 | up to 0.12 | 1.2–1.9 | up to 0.06 | 1.9–2.6 | 0.18–0.25 | 5.2–6.2 | up to 0.06 | — | Bal. |
| 7050 | up to 0.12 | up to 0.15 | 2.0–2.6 | up to 0.10 | 1.9–2.6 | 0.04 | 5.7–6.7 | up to 0.06 | 0.08–0.15 | Bal. |

*All values in per cent by weight

A first difficulty lies in quenching articles composed of age-hardening aluminium alloys in that the rates of cooling to the core of the particular article vary to a great extent depending upon the local thickness of the article. This is illustrated by the graph in FIG. 1 taken from the work "Aluminium", Vol. 1, edited by Kent R. Van Horn under the auspices of the American Society for Metals, the British units of which (thickness in inches and temperature in degrees Fahrenheit) have been converted to international units.

The graph shows as abscissa, the average cooling rate in degrees Centigrade per second between 399° and 288° C. of the core of a metal sheet, the thickness of which is given along the ordinate for different temperatures of the quenching water. The curve in broken lines being the theoretical maximum assuming that the surface of the sheet metal cools instantaneously at 99° C. at the moment of quenching.

Figure 1:
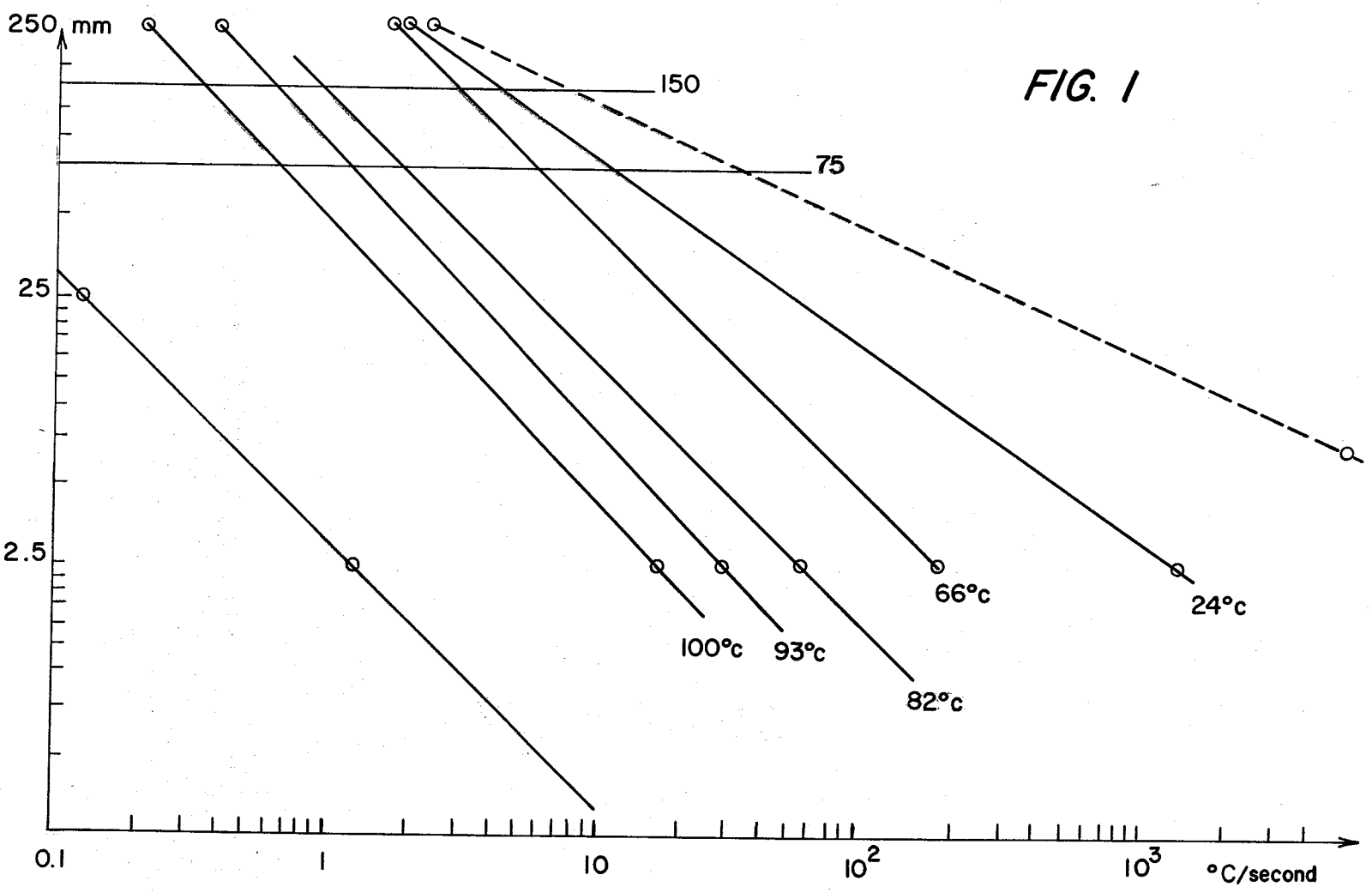
FIG. 1 is a graph showing core cooling rates with relation to thickness of aluminium alloys.

Examination of the graph shown in FIG. 1 demonstrates that in the case of 150 mm thick articles, the rate of cooling to the core varies between 0.3° and 0.4° C. per second in boiling water, and 4° C. per second in cold water at 24° C. The maximum rate of cooling is of the order from 6° to 7° C. per second, owing to the thermal conductivity of the metal, assuming that the skin cools instantaneously at 99° C.

The corresponding figures for a thickness of 75 mm are as follows: in boiling water from 0.6° to 0.7° C. per second; in cold water about 10° C. per second; and at the theoretical maximum rate, about 30° C. per second.

This difference between the theoretical maximum rates and the rates observed during experiments is caused by the fact that the surface of the quenched article, after having been subjected initially to quenching, i.e., to extremely rapid cooling and to hyper-quenching, is surrounded immediately by a sleeve of water vapor which substantially reduces the heat exchange, thus producing a surface temperature well above the 100° C., which therefore limits the flow of heat owing to the conductivity within the article.

It is well known that in order for age-hardening aluminium alloys to react to artificial aging, they have to be quenched at a cooling rate which is sufficiently high for the hardening elements to remain in a saturated solid solution.

For the alloy 7075, for example, this critical quenching rate is of the order of 40° C. per second. It is clear that, in these conditions, even a 75 mm thick article would not be perfectly quenched. French Certificate of Addition No. 2,293,496, incorporated herein by reference entitled "A Process for Reducing the Critical Quenching Rate of Aluminium Alloys Having High Properties" describes a process for using means for quenching which are less vigorous than cold water such as still air or boiling water which provides quenching without a significant loss in mechanical properties. This process involves carrying out thermal treatment at a temperature, $T_t$, between the temperature of the solidus equilibrium ($T_1$) and that of the liquidus ($T_2$) of the alloy for a period between 0.5 and 12 hours.

Figure 2:
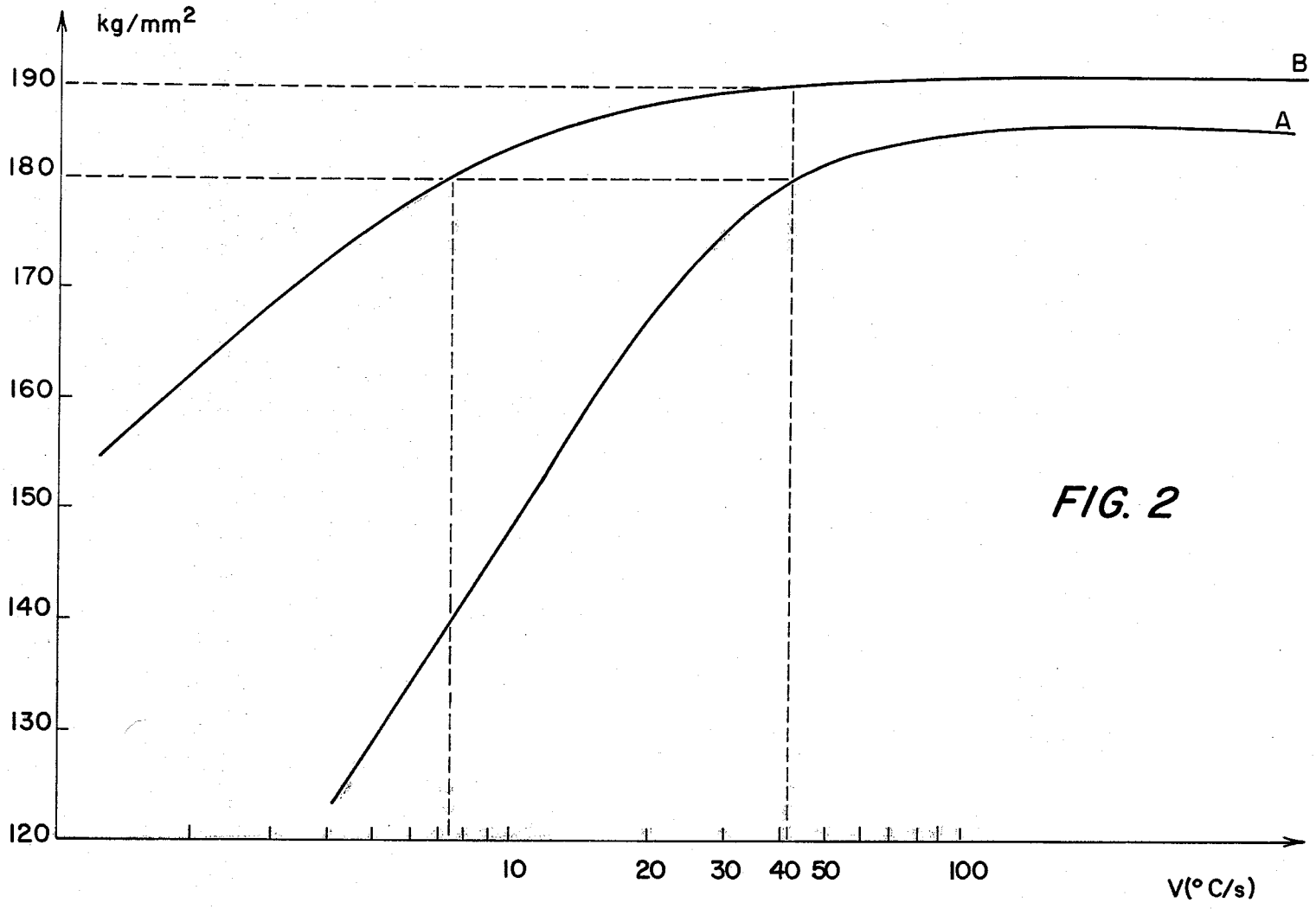
FIG. 2 is a graph showing cooling rates with relation to mechanical properties of aluminium alloys.

Under these conditions the mechanical properties demonstrated by the Vickers hardness system are shown in FIG. 2 which has been taken from the hereinbefore mentioned certificate of addition.

The curve A shows the alloy treated in accordance with the prior art and curve B shows the alloy treated according to the certificate of addition No. 2,293,496.

It is observed that a cooling rate of the order of 40° C. per second, which according to the Van Horn table, corresponds to cold water quenching of an article which is not too thick (between 25 and 50 mm). The characteristics obtained are very close to the maximum characteristics of an article treated according to the prior art and are comparable to those obtained on an article treated according to the invention at a quenching rate of only 8° C. per second.

This improvement is due to the reduction of the critical quenching rate obtained by the process of the invention. The Van Horn table shows that for thickness of 75 mm, this rate of 8° C. per second is only obtained at the core if quenching is carried out with cold water, and cannot be obtained at the core for thicknesses of 150 mm. However, a second difficulty arises; quenching by very "vigorous" means such as cold water is a source of residual tension, thus causing deformation of articles after machining owing to the extremely harsh cooling only of the external area of the articles due to the evacuation of heat which is blocked at a very small distance below the surface owing to the thermal resistance of the aluminium and particularly to the film of the vapor which is formed almost instantaneously about the surface of the article. A situation is thus reached where the quenching rate is much too high at the surface and too low inside the article.

Unfortunately it so happens the thermal treatment at a temperature above that of the true solidus of the alloy causes greater sensitivity to the effect of the creation of residual stresses induced by harsh cooling.

The explanation is as follows:

As a first approximation, the total deformation created by quenching is proportional to $\Delta T$, the difference of temperature between the core and the surface of the articles:

$\epsilon T = \text{total deformation} = \alpha \Delta T$

This deformation $\epsilon_T$ is the sum of an elastic deformation and a plastic deformation, the latter being permanent:

$\epsilon T = \epsilon \text{elastic} = \epsilon \text{plastic}$

The elastic deformation is equal to ($\sigma O/E$) where $\sigma O$ represents the elastic limit of the metal and E represents the modulus of elasticity.

Figure 3:
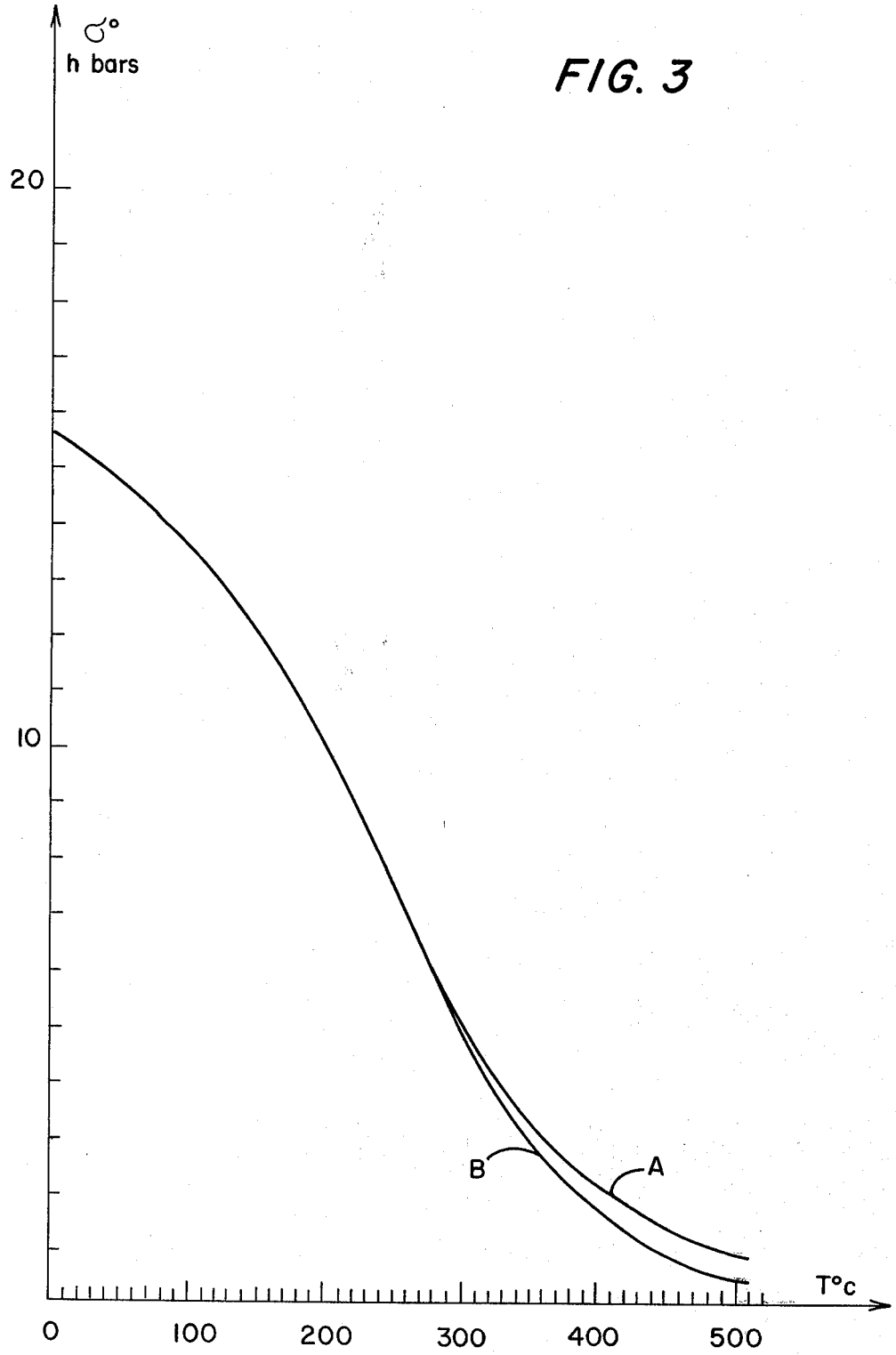
FIG. 3 is a graph showing elastic limit in relation to temperature of aluminium alloys.

The curves in FIG. 3 show the variation of the elastic limit in h bar as a function of the temperature. The curve A shows the evolution of the elastic limit $\sigma O$ of an alloy which has been subjected to normal solution heat treatment below the temperature $T_1$.

The curve B shows the evolution of the elastic limit $\sigma O$ of an alloy which has been subjected to thermal treatment at a temperature above $T_1$.

These two curves are practically combined at low temperatures. On the other hand, a disconnection is observed beyond 300° C. where the elastic limits of the curve B are slightly lower than those of the curve A.

This phenomenon is explained by the fact that at high temperatures the alloy no longer owes its mechanical properties to the Guinier-Preston zones which have been re-absorbed in the matrix but to the dispersoids which remain (hardening by dispersed phases). In the metal treated beyond $T_1$, these dispersoids have coalesced, that is to say, they are larger and more distant from each other than in the metal subjected to conventional dissolution.

Since the elastic limit is thus lower and E, the modulus of elasticity whose value is connected to the matrix and not to the dispersed phases does not vary in proportion with the conventionally treated metal, $\sigma O/E$ will be lower, analogously to $\epsilon_{elastic}$.

Since:

$\epsilon_T = \epsilon_{elastic} + \epsilon_{plastic}$, if $\epsilon_{elastic}$ is lower, $\epsilon_{plastic}$ will be higher, thus the permanent deformation of the alloy will be greater.

The treatment process of the invention combines: the thermal treatment at high temperature, coating of articles previously quenched with the aid of an insulating coating and quenching articles in hot or boiling water.

If the articles to be quenched are covered with an insulating and refractory coating before the solution heat treatment preceding quenching, it is observed, unexpectedly, that the cooling rate during water quenching increases. This is explained in the following manner, although the theory of the invention is not intended to limit the scope thereof. Since the coating is insulating a large temperature gradient is created within this coating, the external surface of the coating is at a lower temperature upon contact with the water than the surface of the uncoated article would be. Also, nucleated boiling with high thermal exchanges replaces boiling in a film below a certain wall temperature.

Under these conditions, nucleate boiling is attained very quickly and the overall cooling rate of the article is thus increased.

In spite of this overall increase in the quenching rate, the deformations are not increased since, as shown, these deformations are proportional to ΔT, the temperature difference between the core and (surface) of the articles. If the average ΔT in the case of coated articles is higher than that of the uncoated articles, the variation thereof during the quenching period is very different. This phenomenon is illustrated in FIGS. 4 and 5, and 6 and 7.

Figure 4:
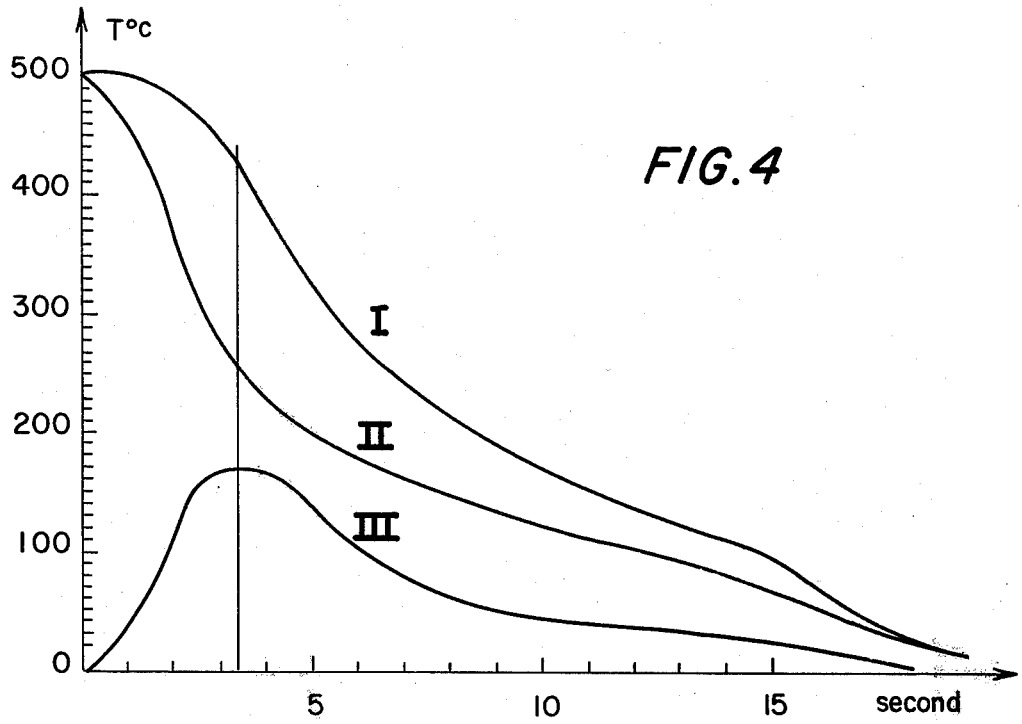
FIG. 4 is a graph showing the variation in temperature as a function of the time from the beginning of quenching at various points within a 50 millimeter diameter aluminium cylinder with water quenching at 20° C. and no insulating coating.

FIG. 4 shows the variation as a function of the time from the beginning of quenching, of the temperature at the center of a 50 mm diameter cylinder (curve I), of the surface temperature of the same cylinder (curve II), of the temperature difference between the center and the surface (curve III), in the case of water quenching at 20° C., the article being composed of A-$U_4$SG(2014) not having been covered with an insulating coating.

Figure 6:
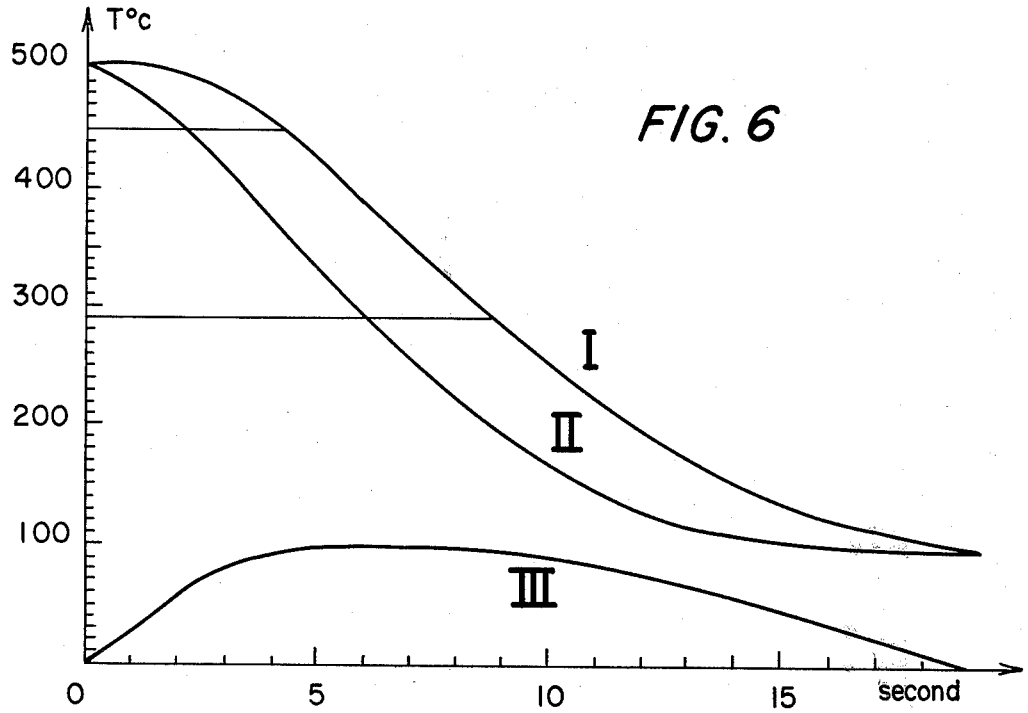
FIG. 6 is a graph showing the same relationships as FIG. 4 except with water quenching at 100° C. and the article coated with an insulating coating.

FIG. 6 shows the same temperature variations as a function of time with the same reference numerals I, II, III, in the case of an identical cylinder, composed of the same alloy, quenched this time in water at 100° C., the article having been covered with an insulating coating.

The essential difference lies in the appearance of the curve of ΔT as a function of the time which shows, in the case of quenching without coating, a marked peak in the region of the very first seconds of quenching whereas in the case of quenching with coating, a peak is not observed but rather a sort of plateau for the majority of quenching with a ΔT which is substantially constant.

The curves I, II, III, in the case of water quenching at 20° C. with a coating and at 100° C. without a coating (not shown) would show that the existence of the peak in the curve for ΔT (curve III), is associated with the absence of coating. It is therefore observed an amplitude which is definitely smaller in the case of boiling water quenching without coating, whereas the plateau at ΔT which is substantially constant is observed during water quenching at 20° C. of coated articles.

Figure 5:
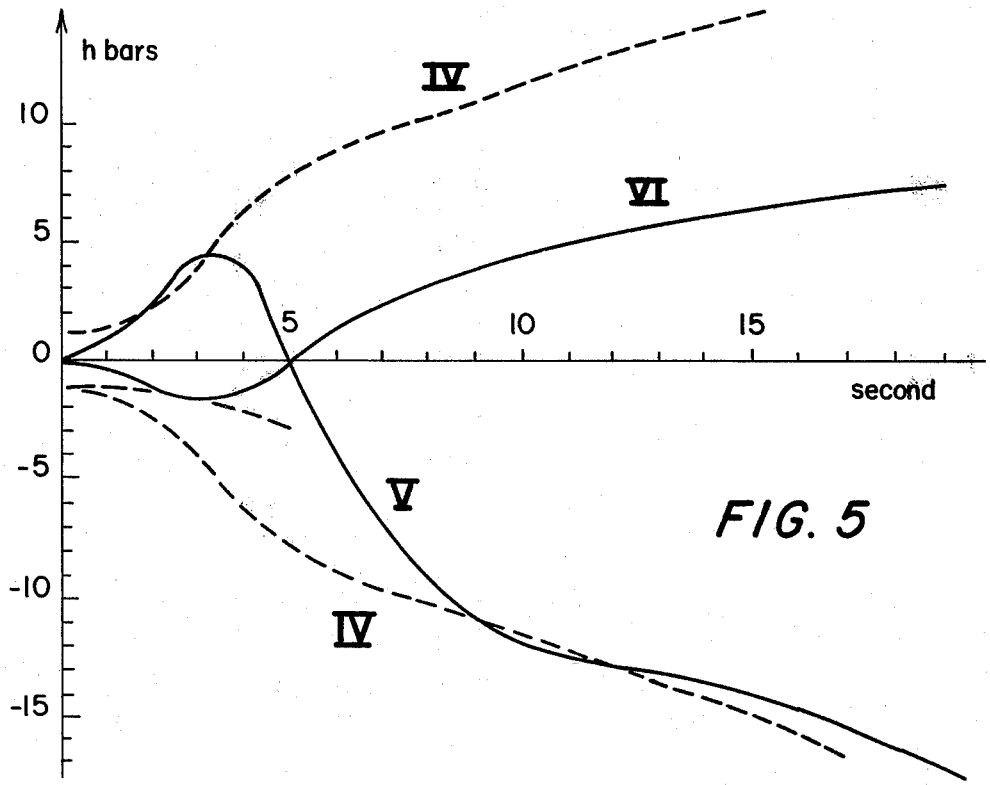
FIG. 5 is a graph showing the variation of elastic limit as a function of quenching time on uncoated aluminium articles quenched at 20° C.
Figure 7:
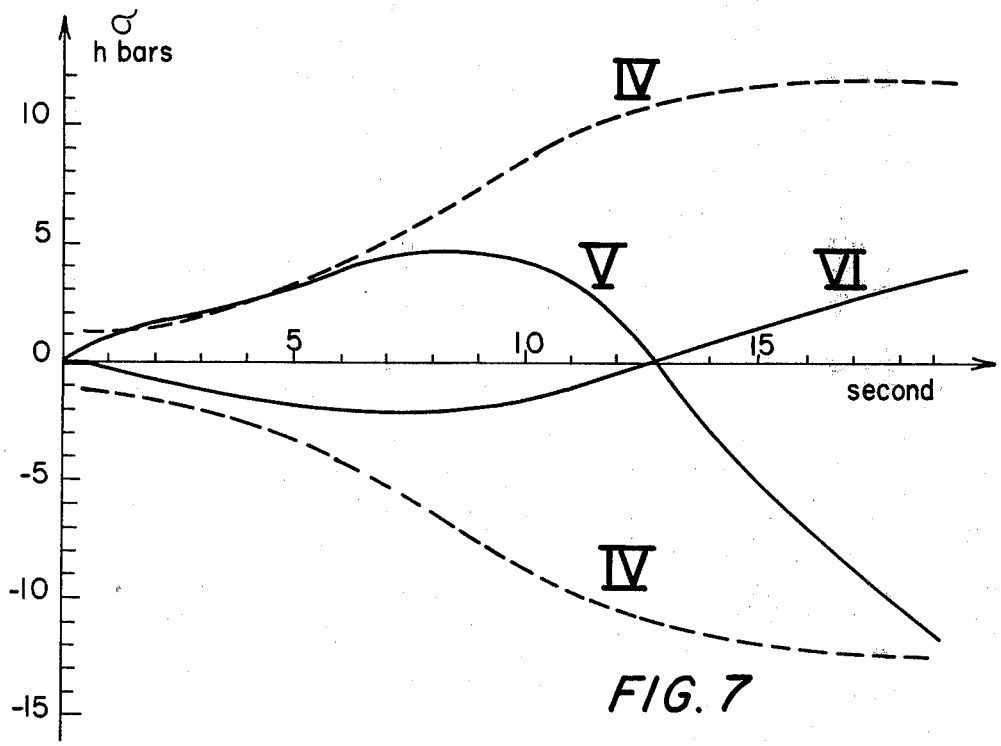
FIG. 7 is a graph showing the variation of elastic limit as a function of quenching time on a coated aluminium article quenched at 100° C.

In the curves in FIGS. 5 and 7, curves IV and IV′ show the variation of the elastic limit of the alloy at the surface of the cylinder as a function of the quenching time. The curve IV has been plotted according to the curve of cooling II by measuring the elastic limit of the alloy as a function of the temperature. The curve IV′ is a symmetrical to the curve IV about the time axis. This curve has been plotted so as to show the points where the absolute value of the surface tangential stress represented by the curve V exceeds the elastic limit since this stress which is initially positive, then becomes negative.

The curves V and VI represent the tangential stresses at the surface and in the center respectively. They are calculated from the cooling curves and experimental mechanical properties of the alloy as a function of the temperature. A comparison between FIGS. 5 and 7 illustrates two phenomena:

(a) in the case of cold water quenching without coating, the curve of the surfaces stresses exceeds the elastic limit at two points, one in the vicinity of the peak of ΔT and the other towards the tenth second creating two plastic deformations in the opposite direction. Moreover, the difference in the surface and central stresses after quenching amounts to 25.2 h bars in this case; and (b) in the case of boiling water quenching with coating, the curve of the surface stresses only exceeds slightly the curve of the elastic limit as it is approximately tangential thereto.

The difference between the surface and core stresses after quenching is not more than 16.5 h bars. The application of an insulating coating also has another effect which is hereinafter described.

Figure 8:
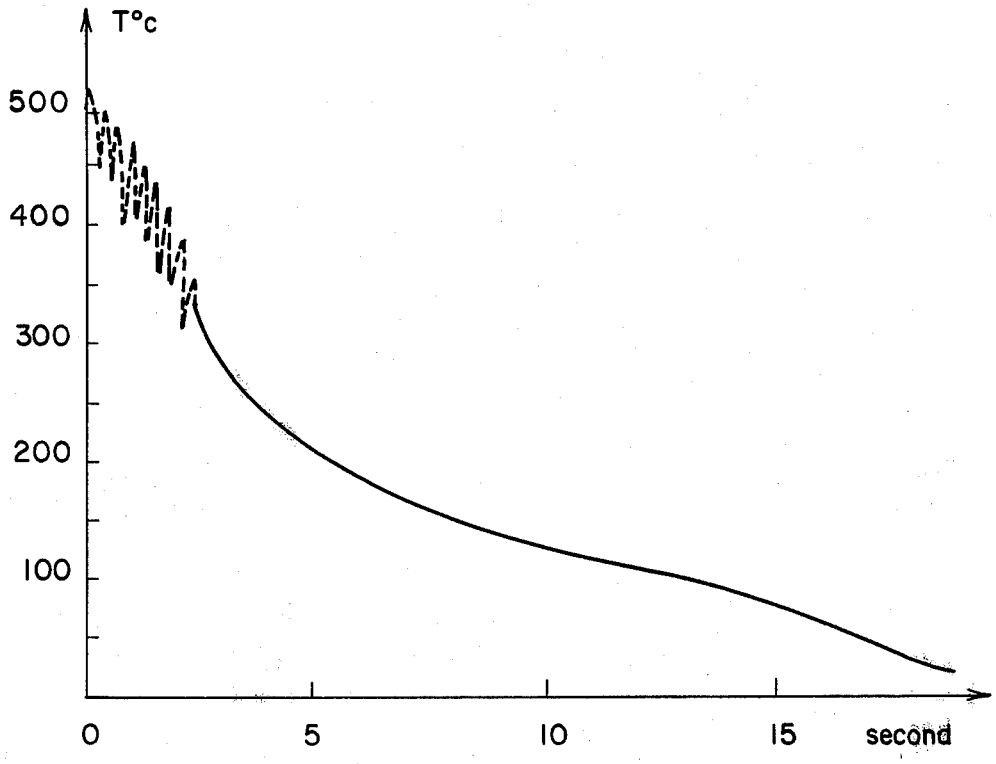
FIG. 8 is a graph showing the variation of surface temperature during the first seconds of quenching of an aluminium article.

The curve II in FIG. 4 is not, in fact, of physical significance because, during the first seconds of quenching, the variation in surface temperature is subjected to irregular variations owing to the instability of the vapor film as may be illustrated by the curve in broken lines shown in FIG. 8. These variations which are too rapid to be detected by a thermocouple are very harmful in two ways. Firstly, they contribute to the increase in the level of the residual stresses which accumulate and, above all, each elementary cooling treatment consists of a phase for germinating hardening phases while subsequent heating consists of an increasing phase which reduces the sensitivity of the alloy to tempering because a proportion of the hardening element has already precipitated and coalesced during the quenching treatment.

Thus, the invention therefore is the combination of three means which react together synergistically to overcome their respective individual disadvantages and reach a satisfactory compromise in characteristics and residual stresses. The thermal treatment at high temperature allows the critical rate of quenching to be reduced, therefore the rate of cooling to be increased sufficiently in the core of thick articles. However, since it increases the residual stresses, it is necessary to provide milder quenching means: hot or boiling water and the coating which allow the overall rate of cooling to be increased while at the same time preventing a core-surface temperature difference which is too high at the beginning of the quenching treatment as this would increase the level of the stresses.

The combination of these three means may be provided in two variations according to the object to be achieved and particularly dependent upon the thickness of the article.

1. If maximum characteristics are to be maintained in the core of relatively thick articles, for example, up to about 75 mm thick, hot water quenching at about 70° C. is employed.

The combination of the three means: thermal treatment, coating and quenching will ensure that high mechanical properties are obtained in the core by reducing the critical rate of quenching (intrinsic properties of the alloy), and by simultaneously increasing the rate of cooling the core. Although the level of residual stresses is significant, it will however be lower than that of articles quenched in cold water.

2. If the residual stresses in particular are to be avoided in articles which are substantially thicker (of the order of 150 mm, for example), boiling water will be used for quenching because the presence of a coating and the thermal treatment will provide sufficient characteristics although they are lower than they would be after quenching at 70° C., whereas boiling water quenching will reduce considerably the residual stresses.

It should be noted that if the thermal treatment were carried out at high temperature alone, lower core characteristics would be obtained in these two cases and insufficient mechanical characteristics would be obtained in the case of boiling water quenching.

If, on the other hand, coating and boiling water quenching were used alone, the residual stresses would be reduced considerably but, in spite of the overall increase in the cooling rate of the core caused by the coating, the characteristics would be insufficient since the rate of cooling, although increased, would be lower than the critical rate of quenching.

Furthermore, local scaling of the coating would have a catastrophic effect on the local properties in this case. However, this effect is attenuated by applying the thermal treatment at high temperature since the gradient of the characteristic curve is slighter as a function of the cooling rate.

The thermal treatment at high temperature which is a step of the process of the present invention is described in French Pat. Nos. 2,256,960 and 2,293,496, incorporated herein by reference. The process disclosed in these French patents involves bringing an aluminium article above the temperature of the solidus of equilibrium $T_1$ while at the same time remaining below the temperature of the liquidus $T_2$ and in keeping it there for a period of from about 0.2 to 12 hours, providing that the hydrogen content of the metal which is likely to be liberated in gaseous form is less than 0.5 ppm and preferably, less than 0.2 ppm or even 0.1 ppm up to the temperature $T_2$ at the moment of treatment.

Two features should be noted with regard to the thermal treatment within the scope of the invention.

1. It may carried out at any time in the cycle for manufacturing forged articles, i.e., on foundry products, billets, slabs or plates intended for forging; on blanks which have already been subjected to preliminary forging or molding; or on the finished product, therefore immediately prior to quenching.

It may be repeated during the cycle, if necessary. For example, it is possible to carry out the following sequence: normal homogenization of a billet, preliminary forging, first treatment at high temperature above $T_1$, forging, coating, second treatment at high temperature above $T_1$, boiling water quenching and artificial aging; and 2. It is not compulsory for the article to be kept at a lower temperature below $T_1$ after the heat treament unless the heat treatment directly precedes quenching since it is not possible to quench a product having a liquid phase without damaging it irreparably.

The method of coating the article with an insulating coating involves depositing by any means a layer, which is temporarily adhesive, of insulating refractory material, for example by brush, gun, dipping or the like. This operation, the effect of which will be felt during quenching, must be carried out before the solution heat treatment.

The insulating coatings are selected for their properties of thermal insulation, of resistance to temperature and to thermal impacts, of adhesion to the article at the moment of application, and of solubility and, finally of quenching.

Excellent results have been obtained when using a mixture of barium sulphate, titanium dioxide, sodium silicate and water in suitable proportions. (coating $RF_1$)

It is also possible to use a mixture prepared prior to use comprised of cellulose glue, glycerol, refractory cement and rutile ($TiO_2$) in suspension with a second mixture comprising plaster in suspension in a sodium silicate solution (coating $RF_x$). These formulae are only given as an example and other types of insulating coatings may be used without departing from the scope of the invention, such coatings known to those skilled in the art.

These coatings are applied as uniformly as possible on the entire external surface of the article to be treated. It is usually sufficient to apply a single layer, the non-critical thickness of which is of the order of several tenths of a millimeter, up to 1 mm in the exceptional case of viscous coating compositions.

Hot or boiling water quenching does not have special features with regard to the prior art. It involves immersing the articles as soon as they leave the solution heat treatment furnace.

The following examples will be illustrative of the invention without restricting the scope thereof.

EXAMPLE 1

7075 alloy billets having the nominal composition previously described are used for manufacturing a solid forged article having the general shape of a 152 mm diameter cylinder.

The temperature of solidus of equilibrium (melting point beginning at equilibrium) of this alloy is about 532° C.

Half of the billets were subjected to a conventional type of homogenization treatment, that is to say four hours at 467° C. (batch A) before forging, while the other half was subjected to a high temperature homogenization treatment above the beginning melting point, that is to say four hours at 540° C. (batch B). The billets are then forged so as to obtain defined forged articles. Half of each of the two batches A and B are covered with a coating composed of a suspension of titanium dioxide and barium sulphate in a sodium silicate solution. The other half of the articles are left without a coating.

Two batches of coated articles $A_1$ and $B_1$ and two batches of uncoated articles $A_2$ and $B_2$ are thus obtained. All the articles are then subjected to a heat treatment for three hours at 470° C. Each of the four batches is then quenched either in boiling water or in hot water at 70° C., producing eight different batches. An artificial aging treatment is then carried out on each of these batches in two stages, for six hours at 105° C. then for eight hours at 177° C. The table below shows the level of residual stresses for each of the eight experimental conditions measured in h bar at the core of the cylinder in the axial direction as well as the mechanical properties at the core in the short transverse direction.

TABLE II

| Homogenization | | Coating | | Quenching | | Mechanical properties h bar | | | Residual Stresses |
|---|---|---|---|---|---|---|---|---|---|
| Conventional | High Temp. | Yes | No | 70° | 100° | LE | R | A | at core: Axial Direction |
| X | | | X | X | | 37.9 | 46.2 | 8.8 | 18 |
| X | | | X | | X | 10.8 | 25.7 | 20.7 | 2.5 |
| X | | X | | X | | 40.0 | 47.5 | 8.3 | 13 |
| X | | X | | | X | 32.5 | 41.3 | 9.6 | 6 |
| | X | | X | X | | 45.3 | 51.9 | 7.5 | 22 |

TABLE II-continued

| Homogenization | Coating | | Quenching | | Mechanical properties h bar | | | Residual Stresses |
|---|---|---|---|---|---|---|---|---|
| Conventional High Temp. | Yes | No | 70° | 100° | LE | R | A | at core: Axial Direction |
| X | | X | | X | 20.2 | 33.1 | 11.0 | 3.5 |
| X | X | | X | | 45.8 | 52.4 | 8.1 | 16 |
| X | X | | | X | 41.2 | 49.3 | 10.0 | 7.5 |

LE : Yield strength (h bar)
R : Tensile strength (h bar)
A : Elongation (%)

It is obvious that the process according to the invention illustrated in the last two lines of the table gives the best compromise between mechanical properties and stresses. Depending upon the individual case, quenching at 70° C. will be selected if maximum properties are desired or, on the other hand, quenching at 100° C. will be selected if minimum stresses are desired.

EXAMPLE 2

Figure 9:
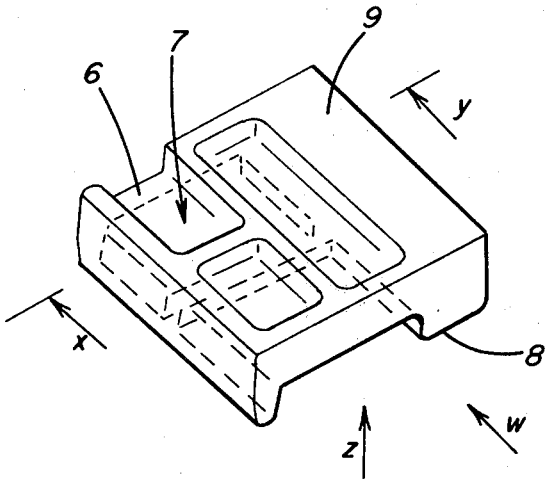
FIG. 9 is a perspective view of an article useful in aeronautical applications.
Figure 10:
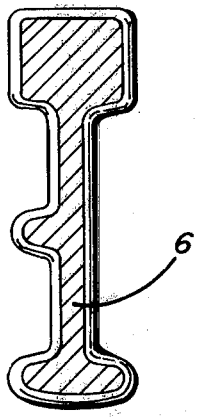
FIG. 10 is a sectional view of the article shown in FIG. 9 along the xy direction.

An article having the general shape shown in FIG. 9 has approximate dimensions of 400 mm×333 mm×98 mm. Two articles of this type labeled N are subjected to a series of conventional thermal treatments with water quenching at 65°. Two articles labeled E are subjected to the same series of conventional thermal treatment followed by water quenching at 65° C. Before the quenching treatment, they were coated with a first known insulating coating $RF_1$. Two articles labeled X are subjected to the same series of conventional thermal treatment followed by water quenching at 65° C. They were coated with a second known insulating coating $RF_X$ before quenching. Finally, an article labeled T is subjected to a high temperature thermal treatment then, after applying the insulating coating $RF_1$ and quenching in boiling water.

In order to demonstrate the residual stresses, two successive machining operations are carried out on these articles. The first operation involves eliminating the internal cloth 6 forming the base of the shell 7 by removing chippings. The two arms of the shell then tend to deform and the variation in the distance between these two arms is measured before and after removing the sheet metal.

Figure 11:
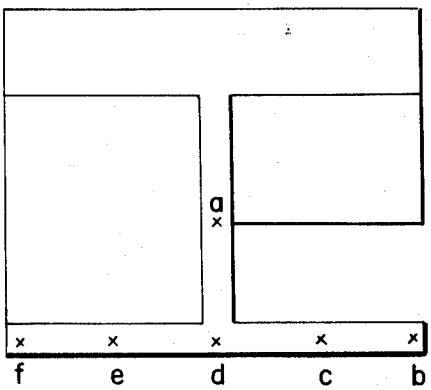
FIG. 11 is a bottom view, along the z direction, of the article shown in FIG. 9.
Figure 12:
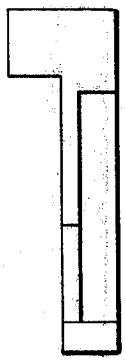
FIG. 12 is a view from the right along the w direction of the article shown in FIG. 9.

The upper surface of the article is then machined completely, causing the disappearance of all the ribs forming the walls of the shell and of the boxes forming the upper part of the article which then has the shape shown in FIG. 11 in a view from below and in FIG. 12 in a view from the right. The article is then placed on the face 8 and is clamped onto the planar part resting on the face 9. The variations in dimensions are then measured at the points labeled a, b, c, d, e, f in FIG. 11.

The result of this measurement is shown in the table below in which the average deformations measured are given when two identical articles were treated:

| Article Label | Coating before Quenching | Temp.of Quenching Water | Thermal Treatment of Dissolution | Between Arms of the Shell | Deformation in mm a | b | c | d | e | f | Average b + c + d + e + f |
|---|---|---|---|---|---|---|---|---|---|---|---|
| N | None | 65° | Conventional | 3.0 | 1.8 | 5.0 | 4.0 | 3.4 | 3.7 | 4.8 | 4.2 |
| E | $RF_1$ | 65° | Conventional | 1.5 | 1.4 | 3.9 | 3.3 | 3.0 | 3.2 | 3.8 | 3.4 |
| X | $RF_X$ | 65° | Conventional | 0.8 | 1.5 | 3.4 | 2.7 | 2.8 | 2.8 | 3.2 | 3.0 |
| T | $RF_1$ | 100° | High. Temp. | 0.7 | 0.7 | 1.7 | 1.3 | 1.2 | 1.4 | 1.6 | 1.3 |

It is observed that the deformations of the arms of the shell are divided by two when the coating $RF_1$ is applied and by four when the coating $RF_X$ is applied or when the coating is combined with boiling water quenching.

With regard to the deformations at points a to f, only the treatment according to the invention has a substantial influence on the deformations. The improvement caused by the coatings alone only has a more restricted favorable influence. The mechanical properties measured at different points of the articles are of the same order of magnitude.

Although the invention has been described with respect to specific compositions and temperature ranges, the invention is not to be limited only so far as is set forth in the accompanying claims.

We claim:

1. In the process for the treatment of a finished or semi-finished forged product having a relatively thick section made from billets or cast plates of age-hardening aluminum alloys useful in aeronautical applications, the improvement comprising:

thermally treating said product between the solidus temperature of equilibrium ($T_1$) and the liquidus temperature ($T_2$) for a period of 0.5 to 12 hours; coating the entire surface of said product with an insulating coating to increase the hardness of said product;

solution heat treating said coated product; and quenching said coated product in hot or boiling water.

2. The process of claim 1 wherein said thermal treatment is carried out on a foundry billet or crude plate.

3. The process of claim 1 wherein said thermal treatment is carried out on a rough forged product.

4. The process of claim 1 wherein said thermal treatment is carried out on a finished product immediately subsequent to solution heat treatment and is followed immediately prior to quenching by a stage at a temperature below $T_1$.

5. The process of claim 1 wherein said product is of an evolutionary shape having a thickness greater than 75 mm, and composed of alloys consisting essentially of:

up to 0.40% Si
up to 0.50% Fe
1.2 to 2.6% Cu
up to 0.30% Mn
1.9 to 2.9% Mg
up to 2.9% Cr 5.1 to 6.7% Zn
up to 0.10% Ti
0 or 0.08 to 0.15% Zr
balance Al
and wherein said quenching is in boiling water.

6. The process of claim 1 wherein said product is of an evolutionary shape and relatively thick but less than 75 mm, and composed of alloys consisting essentially of:
up to 0.40% Si
70 to 0.50% Fe
1.2 to 2.6% Cu
up to 0.30% Mn
1.9 to 2.9% Mg
up to 2.9% Cr
5.1 to 6.7% Zn
up to 0.10% Ti
0 or 0.08 to 0.15% Zr
balance Al
and wherein said quenching is in hot water.

* * * * *

UNITED STATES PATENT AND TRADEMARK OFFICE

CERTIFICATE OF CORRECTION

PATENT NO. : 4,177,086

DATED : December 4, 1979

INVENTOR(S) : Jean-Marie A. Bouvaist et al.

It is certified that error appears in the above-identified patent and that said Letters Patent are hereby corrected as shown below:

Column 1, line 68, delete "article" and insert --articles--.

Table I, under the heading "Cr*", delete "0.10" and insert --0.18--.

Column 4 , line 17, delete the parentheses.

Column 5, line 7, delete the parentheses.

Column 5, line 49, delete "a".

Column 7, line 41, delete "treament" and insert --treatment--.

Claim 6, Column 11, line 10, delete "70" and insert --up--.

Signed and Sealed this

Sixth Day of July 1982

[SEAL]

*Attest:*

GERALD J. MOSSINGHOFF

*Attesting Officer*

*Commissioner of Patents and Trademarks*